US008491111B2

(12) United States Patent
Gray et al.

(10) Patent No.: US 8,491,111 B2
(45) Date of Patent: Jul. 23, 2013

(54) CONSUMABLE SUPPLY ITEM WITH CAPACITIVE FLUID LEVEL DETECTION FOR MICRO-FLUID APPLICATIONS

(75) Inventors: Trevor Gray, Versailles, KY (US); Jason Vanderpool, Lexington, KY (US); Robert Muyskens, Lexington, KY (US); David Ward, Lexington, KY (US); Gregory Webb, Lexington, KY (US); Marvin Nicholson, III, Lexington, KY (US); Jason McReynolds, Georgetown, KY (US)

(73) Assignee: Funai Electric Co., Ltd. (JP)

( * ) Notice: Subject to any disclaimer, the term of this patent is extended or adjusted under 35 U.S.C. 154(b) by 227 days.

(21) Appl. No.: 13/036,802

(22) Filed: Feb. 28, 2011

(65) Prior Publication Data

US 2012/0218356 A1 Aug. 30, 2012

(51) Int. Cl.
*B41J 2/175* (2006.01)

(52) U.S. Cl.
USPC ..... 347/86; 347/85

(58) Field of Classification Search
USPC ..... 347/7, 19, 85, 86, 87; 73/1.73, 304 C, 73/304 R
See application file for complete search history.

(56) References Cited

U.S. PATENT DOCUMENTS 3,929,071 A 12/1975 Cialone
4,201,085 A 5/1980 Larson
4,415,886 A 11/1983 Kyogoku
4,853,718 A 8/1989 Elhatem
5,289,211 A * 2/1994 Morandotti et al. ..... 347/7
5,635,962 A 6/1997 Goldis
5,682,184 A * 10/1997 Stephany et al. ..... 347/7
5,788,388 A 8/1998 Cowger
6,431,670 B1 * 8/2002 Schantz et al. ..... 347/7
6,641,240 B2 * 11/2003 Hsu et al. ..... 347/7
6,670,817 B2 * 12/2003 Fournier et al. ..... 324/662
7,029,082 B2 * 4/2006 Farr et al. ..... 347/7
7,370,528 B2 5/2008 Scardovi
7,510,257 B2 3/2009 Jung
7,555,231 B2 6/2009 Etter

OTHER PUBLICATIONS

O.W. Phillips, "Capacitive Ink Level Detector", IBM Technical Disclosute Bulletin, vol. 16, No. 10, Mar. 1974, pp. 3293 and 3294.

* cited by examiner

*Primary Examiner* — Anh T. N. Vo
(74) *Attorney, Agent, or Firm* — Amster, Rothstein & Ebenstein LLP

(57) ABSTRACT

A consumable supply item for an imaging device holds an initial or refillable volume of fluid. Its housing defines an interior having a pair of opposed electrodes. The electrodes define a capacitance that varies in response to an amount of liquid between them. A volume space filled by the liquid varies along a length of the electrodes. The design facilitates abrupt changes in capacitance values at each change in the volume space. Devices can recalibrate fluid levels at these changes. Electrode interior surfaces face one another. At least one electrode has an open region, such as a hole or a cutout of material. In another design, a support material connects to each electrode to provide mechanical stability and create a region preventing filling by the liquid. Further embodiments contemplate material selection, construction, and modularity, to name a few.

17 Claims, 10 Drawing Sheets

CONSUMABLE SUPPLY ITEM WITH CAPACITIVE FLUID LEVEL DETECTION FOR MICRO-FLUID APPLICATIONS

FIELD OF THE INVENTION

The present invention relates to micro-fluid applications, such as inkjet printing. The invention relates particularly to detecting fluid levels in supply items consumed in such applications. Capacitive sensing facilitates certain designs.

BACKGROUND OF THE INVENTION

The art of printing images with micro-fluid technology is relatively well known. A disposable or (semi)permanent ejection head has access to a local or remote supply of fluid (e.g., ink). The fluid ejects from an ejection zone to a print media in a pattern of pixels corresponding to images being printed.

Accurately knowing the amount of fluid available for use during printing lends itself to a variety of consumer features. Imaging devices can warn users of impending depletion of fluid. Users can re-supply fluid to prevent voiding warranties. Imaging can cease to avoid de-priming ejection heads, etc. Manufacturers have implemented a variety of fluid measurement sensors and techniques. Each has its own set of advantages and problems. Some are cheap while others are costly. Some work as intended while others have proven so poorly that users regularly ignore them. Still others are complex, including complicated processing algorithms. The optimum balance is to provide accurate fluid level measurement over a lifetime of a supply item, but without adding complexity or cost. Some of the more popular strategies in the art contemplate float sensors, magnetic sensors, torques sensors, optical sensors, valves, fluid drop-counting, electrical probes, capacitance determinations, or the like.

With capacitive style fluid detection, it is common to fashion two metal plates (electrodes) with spacing between them. Upon application of electrical energy, circuitry measures capacitance of the media (e.g., fluid) residing in the spacing. The amount of capacitance varies according to the amount of the media and level detection is made possible. The plates reside wholly within the fluid or external to a housing containing the fluid. Alternatively, one plate resides in the fluid while the other resides out of the fluid. Spacing between the plates, sizes and shapes of the plates and material selection are just some of the many design options. Pros and cons dictate the choices.

In any design, capacitance detection has inherent drawbacks making them dubious for micro-fluid applications. Variations during manufacturing are influential enough to prevent preciseness in measured capacitance levels. The most problematic variations include improperly distancing plates from one another, improperly orienting them relative to each other or arranging them wrongly on housing containers. Owing to common calibration schemes in devices using the plates, specific capacitance readings cannot be always associated with a specific ink level remaining in the supply item.

Also, capacitance readings correspond typically to a decrease in farads (F) as fluid levels between spaced plates become lower over time. Conversely, refilling fluid leads to higher capacitance readings. Plotting one variable relative to the other usually results in constantly sloped data in graphs, e.g., FIG. 6. However, distinguishing a reading of 8.2 pF from a reading of 8.1 pF does not easily lend itself to knowing an actual height of fluid in a container. While the latter value can be generally acknowledged as corresponding to a height of fluid lower than the former value, correlation to a measurement of height in distance units sometimes proves challenging. Correlation of fluid to an absolute height in distance units above a floor of a container is equally challenging. Similarly, the lowering of farad (F) values with the consumption of liquid is an expected result over time. Little knowledge is learned from measuring decreased capacitance values other than assuming the depletion or lowering of fluid. It would be useful, on the other hand, to know exact heights of fluid in distance units, despite uncertainties in manufacturing variances and calibration techniques. It would be useful further to know height milestones, such as when a container is exactly half full or a quarter empty, for example.

Accordingly, a need exists in the art to improve fluid level detection in supply items of imaging devices, especially when involving capacitance measurement techniques. The need extends not only to improving accuracy, but to translating capacitance readings into beneficial heights of fluid. Simplicity of design is still a further recognized need as is eliminating tolerance variability in manufacturing. Economic advantage is still another consideration. Additional benefits and alternatives are also sought when devising solutions.

SUMMARY OF THE INVENTION

The above-mentioned and other problems become solved with consumable supply items having capacitive fluid level detection for use in micro-fluid applications. The design focuses not on absolute capacitance values of fluids between plates, but instead on rate changes of capacitance that are noticeably abrupt. Various techniques facilitate the design.

A consumable supply item for an imaging device holds an initial or refillable volume of fluid. Its housing defines an interior having a pair of opposed electrodes. The electrodes define a capacitance that varies in response to an amount of liquid between the electrodes. A volume space filled by the liquid varies along a length of the electrodes. Abrupt changes in capacitance values are noticeable at each change in the volume space. Devices can accurately recalibrate fluid levels at these changes.

In one embodiment, electrode interior surfaces face one another. At least one electrode has an open region, such as a hole or a cutout of material. The electrode surface prevents the occupation of fluid, while the open region allows fluid to spill into other locations of the housing. Sharp changes of capacitance readings are noticed at transitions of fluid from and to the open region.

In another embodiment, a support material connects to each electrode. The support adds mechanical stability and creates a region preventing filling by the liquid. Capacitance values change drastically with fluid residing above the support or only below the support. The support can optionally flow fluid through its interior for still other outcomes in capacitance measurements.

In still other embodiments, a supply item has a shape that varies in cross section. At various heights, fluid fills an expansive section of housing while at other heights the fluid is restricted to filling a more narrow section. The electrodes are located to take capacitance readings that observe expansive and narrow transitions in fluid in the housing as the volume of fluid depletes in a direction of gravity toward a bottom of the housing.

Further embodiments contemplate material selection, construction, and modularity, to name a few. The housing can also include various ports, air venting, valves, filters, standpipes, fittings, or other structures useful in fluid mechanics.

These and other embodiments are set forth in the description below. Their advantages and features will be readily apparent to skilled artisans. The claims set forth particular limitations.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that process, electrical, and mechanical changes, etc., may be made without departing from the scope of the invention. The following detailed description is not to be taken in a limiting sense and the scope of the invention is defined only by the appended claims and their equivalents. In accordance with the features of the invention, methods and apparatus include consumable supply items having capacitive fluid level detection for micro-fluid applications, such as ink-jet printing, medicinal delivery, forming circuit traces, misting water, etc.

Figure 1A:
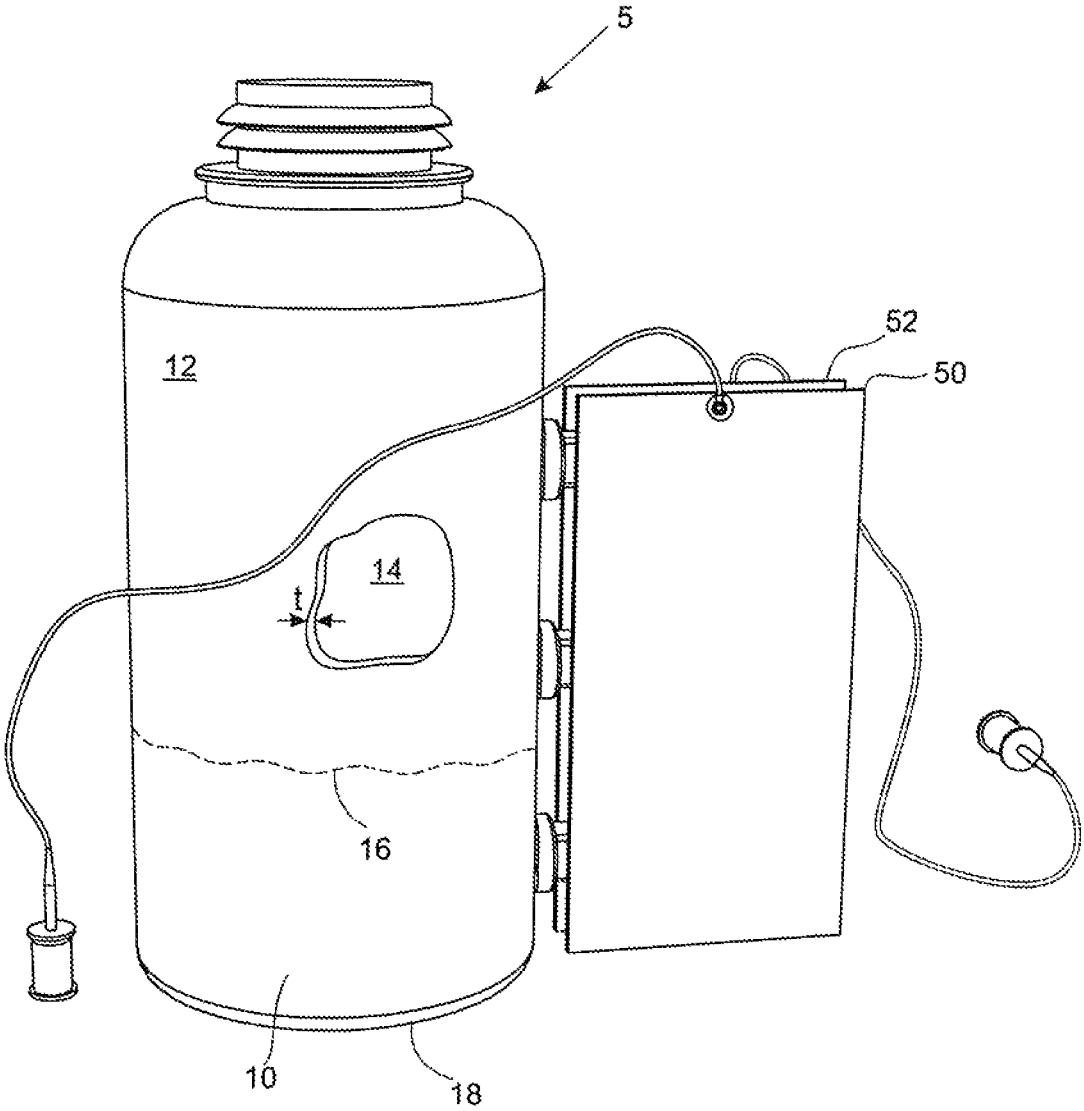
FIGS. 1A and 1B are diagrammatic views of a consumable supply item having capacitive fluid level detection in accordance with the present invention.
Figure 1B:
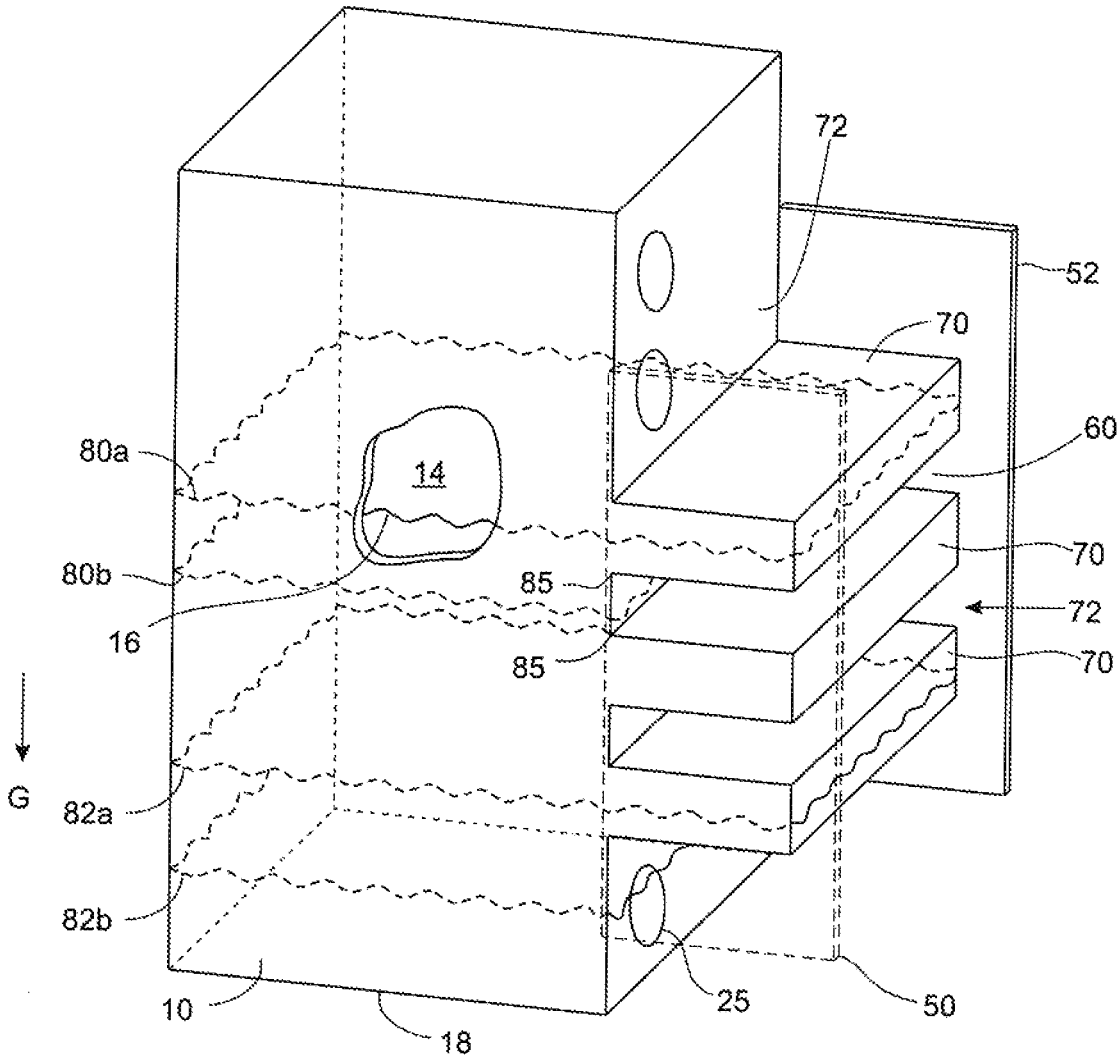

With reference to FIGS. 1A and 1B, an experimental setup is given at element 5. It includes a supply item 10 for consumable use in an imaging device. Its housing 12 defines an interior 14 containing an initial or refillable supply of fluid, such as ink 16. The ink is delivered to the imaging device by a port, such as a septum 25. The port is on a downward side of the housing as the fluid depletes in the direction of gravity G over time. The ink itself is a variety of aqueous inks, such as those based on dye or pigmented formulations. It also typifies color, such as cyan, magenta, yellow, black, etc. It is used in diverse applications.

The housing is any of a variety of containers for holding fluid. Its material embodies glass, plastic, metal, etc. It can be recyclable or not. It can encompass simplicity or complexity. Techniques for producing the housing are variable as well. Blow molding, injection molding, etc. are envisioned. Welding, heat-staking, gluing, tooling, etc. are also envisioned. Selecting materials for the housing and designing the production, in addition to ascertaining conditions for shipping, storing, using, etc. the housing, includes focusing on further criteria, such as costs, ease of implementation, durability, leakage, and a host of other items.

The overall shape of the housing is varied. It is dictated by an amount of fluid to be retained and good engineering practices, such as contemplation of the larger imaging context in which the housing is used. In the design given, the housing is generally cylindrical or rectangular and sits vertically upright. It holds a volume of ink on the order of about 450 ml in a container defining a capacity of about 500 ml. It has a height of about 120 mm. In smaller designs having the same height, the ink volume is about 150 ml in a capacity of about 180-190 ml.

The walls of the housing have a thickness "t." They are generally the same thickness everywhere about an entirety of the housing. They are sufficiently strong to maintain the shape of the housing throughout a lifetime of usage. They are rigid to preventing bowing, tilting and the like. They are not overly thick, however, that material is excessively wasted. The thickness ranges from about 1.5 to about 2.0 mm. The walls may be also formed as a unitary structure in a single instance of manufacturing or as pieces fitted together from individual parts. The latter envisions a modular construction.

In either the modular or integral design, the housing supports a pair of opposed electrodes 50, 52 (electrode 50 being shown in phantom in FIG. 1B). They are situated to detect a fluid level in the housing. They reside fully within the fluid, fully outside the fluid or in a manner that has one electrode in and out of the liquid. Still other designs fashion one or both of the electrodes partially in and out of the fluid. In any design, application of electrical energy to the electrodes forms a capacitor. Its capacitance varies in response to an amount of liquid existing between the electrodes. With greater amounts of fluid, the greater the amount of capacitance that is measured by the electrodes. Conversely, the lesser the amount of fluid, the lesser the amount of capacitance that is measured by the electrodes.

Also, in a space between the electrodes, a volume 60 that can be filled with the amount of liquid varies along a length of the electrodes. The boundaries of the housing are fashioned in a manner to change abruptly so that changes in capacitance values of the fluid in this space correspondingly changes abruptly. The design facilitates known fluid level points enabling accurate recalibration of fluid level sensing at these changes. It resets the industry practice from examining absolute capacitance values to examining rate changes of capacitance that are noticeably abrupt.

In the present embodiment, the supply item 10 has a shape that varies in cross section within the volume space 60. At various heights above the bottom 18 of the housing, fluid fills either an expansive section 70 of housing or is restricted to only filling a more narrow section 72. As the fluid depletes downward with usage, fluid levels can be noted as having a large, upper surface area within the expansive section, such as at levels 80*a*, 82*a*, or levels having a small, upper surface area within the narrow section, such as 80*b*, 82*b*. The volume space allowing the expansion or restriction of fluid at these levels transitions abruptly in the housing interior at multiple positions along the electrodes, such as at positions 85.

Figure 2:
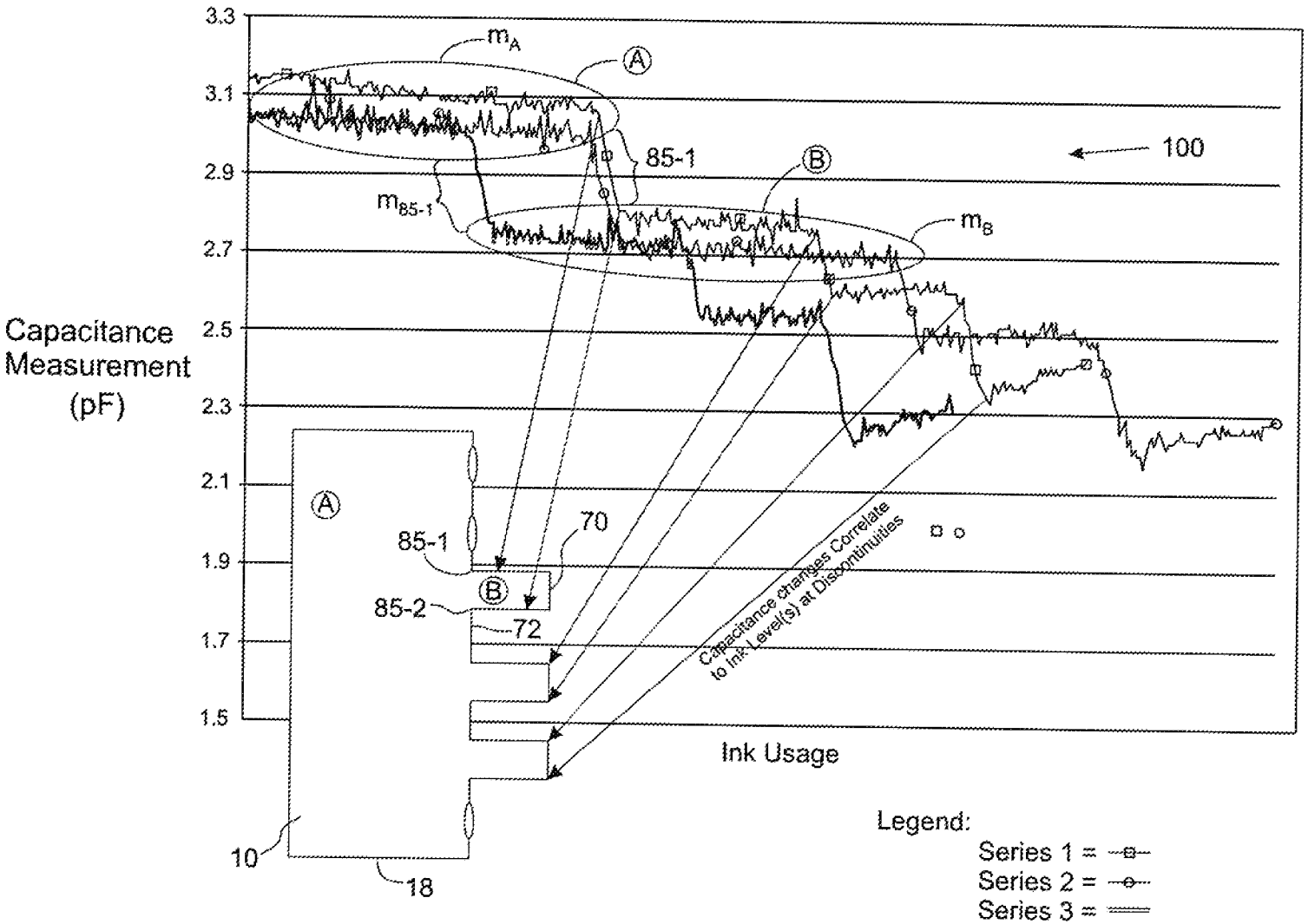
FIG. 2 is a graph of capacitance measurements vs. ink usage for the supply item of FIGS. 1A and 1B.

To illustrate capacitance readings of the electrodes, reference is taken to FIG. 2. Varieties of tests were undertaken by the inventors and are illustrated as Series 1, 2 and 3, according to the legend. One Series varied from the next according to locations of the electrodes. In any series, however, capacitance measurements decrease relative to increasing amounts of ink usage (or relative to decreases in fluid height in the housing). When the fluid level in the housing transitions from an expansive section 70 to a restrictive section 72, sharp changes in capacitance measurements are noticeable. When fluid resides in the housing at volume position A, the slope in the graph 100 at A is but a first slope $m_A$. When fluid in the housing transitions lower at position 85-1 from volume position A to volume position B, there is a drastic change in the slope of the graph 100 at $m_{85-1}$. Later, the slope of the graph 100 reverts to $m_B$, which is comparable to $m_A$. With this method, skilled artisans are now able to examine the changes in slopes (pF/ink usage) instead of raw capacitance values (pF). That positions of transition in the housing can be placed at known volumes of the housing, such as at $\frac{3}{4}^{th}$, $\frac{1}{2}$, $\frac{1}{10}^{th}$, etc., associated imaging devices can recalibrate fluid levels in the housing upon reaching the abrupt changes in slope. For at least this reason, advancement is made over the prior art.

Figure 3:
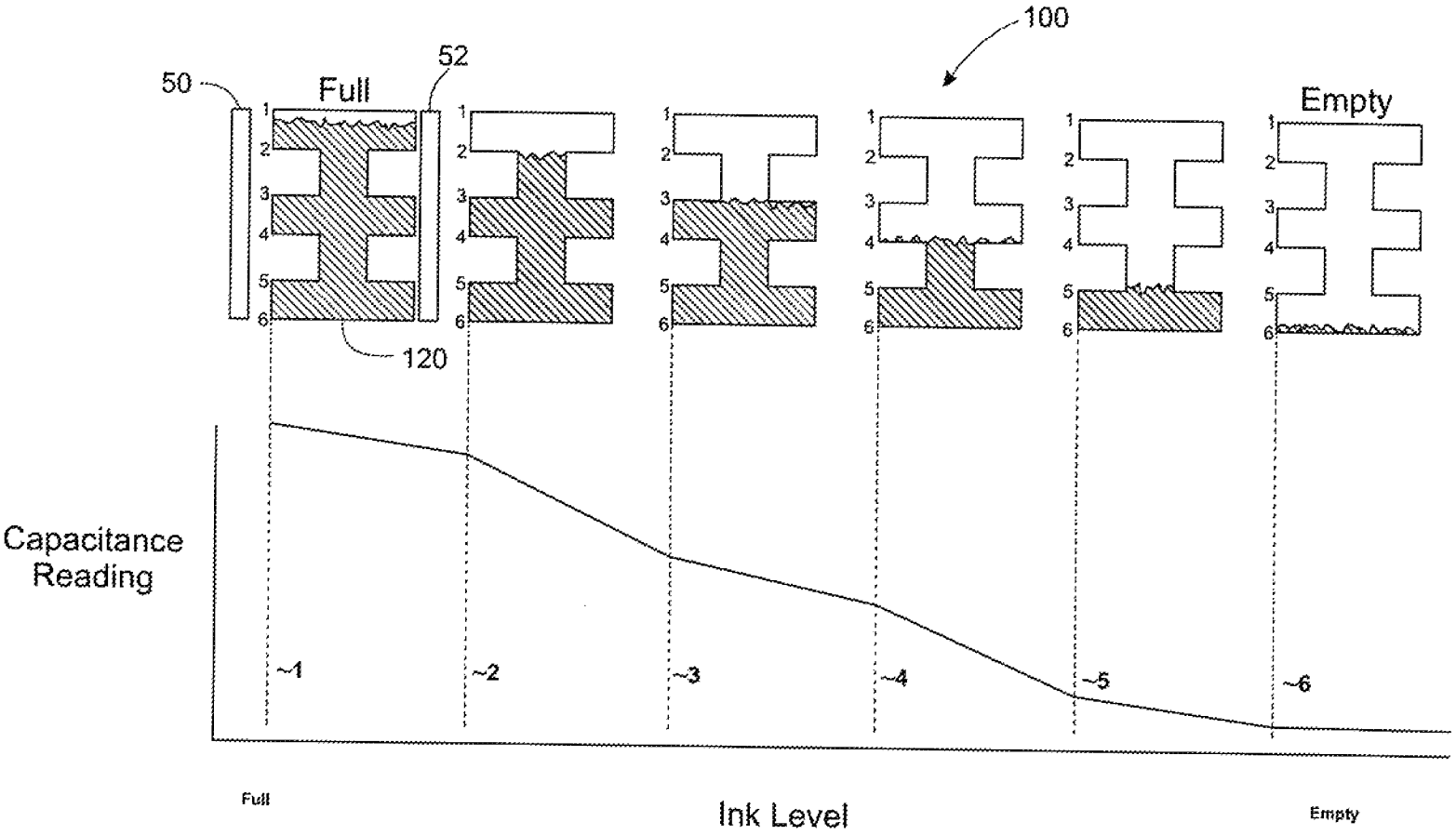
FIG. 3 is a diagrammatic view and graph of an alternate embodiment of a consumable supply item with capacitive fluid level detection.

With reference to FIG. 3, an alternate embodiment of the invention is given as 100. Opposed electrodes 50, 52, are fashioned on an exterior of a housing 120. As fluid depletes in the housing from Full to Empty, abrupt changes in the slope of measured capacitance are noted at positions 1, 2, 3, 4, 5 and 6. They correspond to abrupt changes in the volume space between the electrodes that can be filled with fluid.

Figure 4:
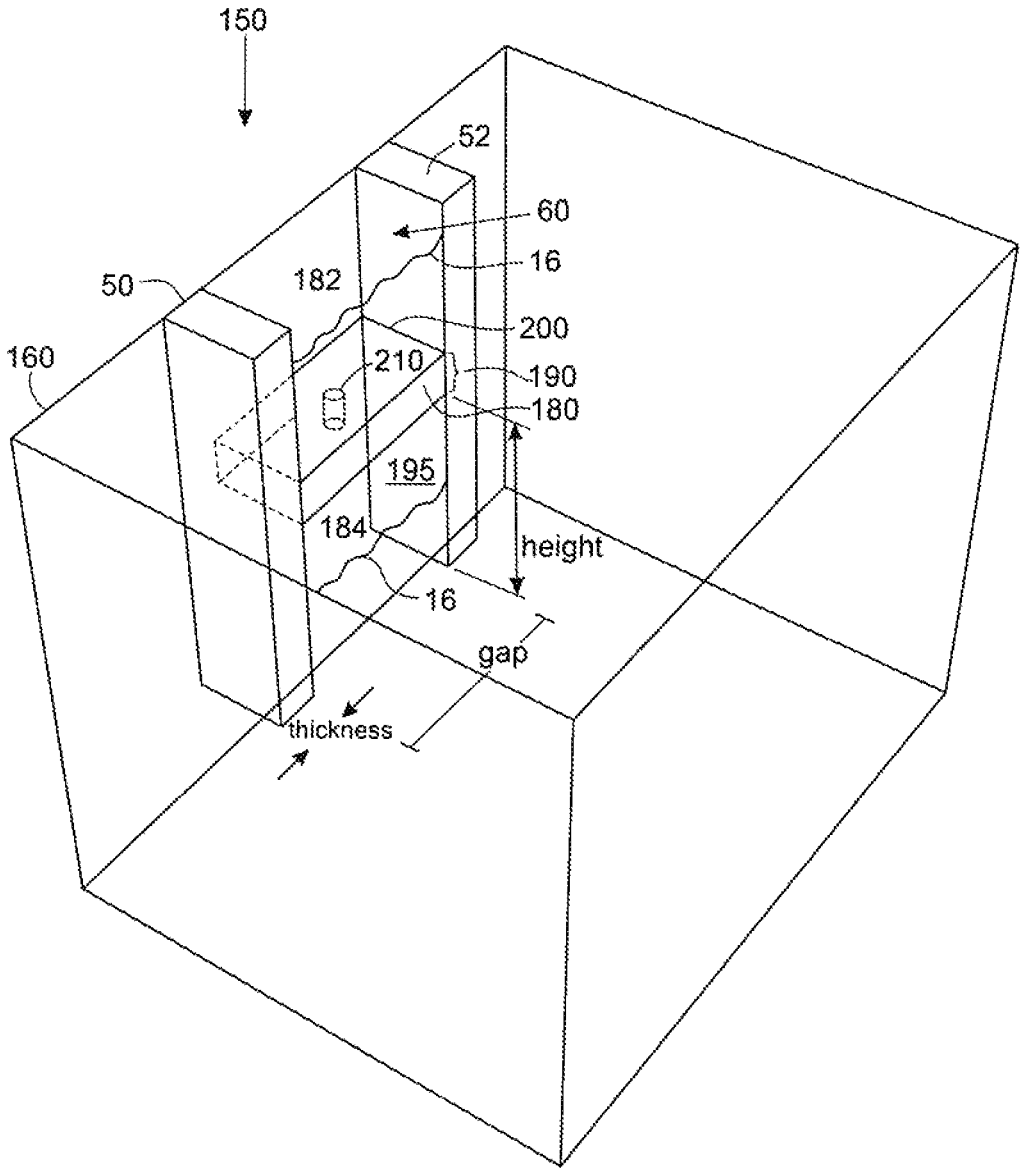
FIG. 4 is a diagrammatic view of another embodiment of a consumable supply item with capacitive fluid level detection.

With reference to FIG. 4, still a further embodiment is given as 150. It includes a housing 160. The housing supports a pair of opposed electrodes 50, 52. The volume space 60 between the electrodes has both wholly open regions available for filling with fluid and those preventing filling. A support material 180 defines the regions. Above and below the support at 182, 184, fluid 16 can reside anywhere between the electrodes. Throughout a thickness 190 of the support, on the other hand, fluid is unable to reside between the electrodes. In this way, an abrupt change in capacitance measurements can be observed as fluid transitions from 182 to 190, and again when it transitions from 190 to 184. The support 180 is also available to add mechanical stability to the electrodes and consistently orient them vertically upright during manufacturing. More than one support may reside in the volume space thereby adding more discrete transitions in capacitance readings and more mechanical support as the situation dictates. The support(s) attach to the electrodes in a variety of ways.

In a preferred design, the electrodes are tin plated steel. They have a thickness from foil thinness to that of a few millimeters. They are over-molded with a fine layer or coating of polypropylene or polyethylene. The coating ranges up to about 1.5 mm. Similarly too, the support material is formed of polypropylene or polyethylene. It is welded to inner surface areas 195 at joints 190. Alternatively, the support material is molded in place when over-molding the electrode pair with its coating.

The spacing Gap of the electrodes from one another defines a relative length of the support material. In one design, the gap ranges from about 4 to about 10 mm. The dimension transverse to the Gap ranges about 1 to about 5 mm. Similarly, the thickness 190 of the support material is 1 to about 5 mm. In an optional embodiment, one or more openings 210 can fluidly communicate through the thickness 190 of the support material to allow limited amounts of fluid to transition from regions 182 to 184. This provides still further outcomes in capacitance measurements. The opening can be of any shape. The height placement of the support 180 can be anywhere along the length of the electrode. Preferred heights exist at known milestones of fluid volume in the housing, e.g., one-half. A central location about midway between a top and a bottom of the electrodes is a preferred location, as shown.

Figure 5A:
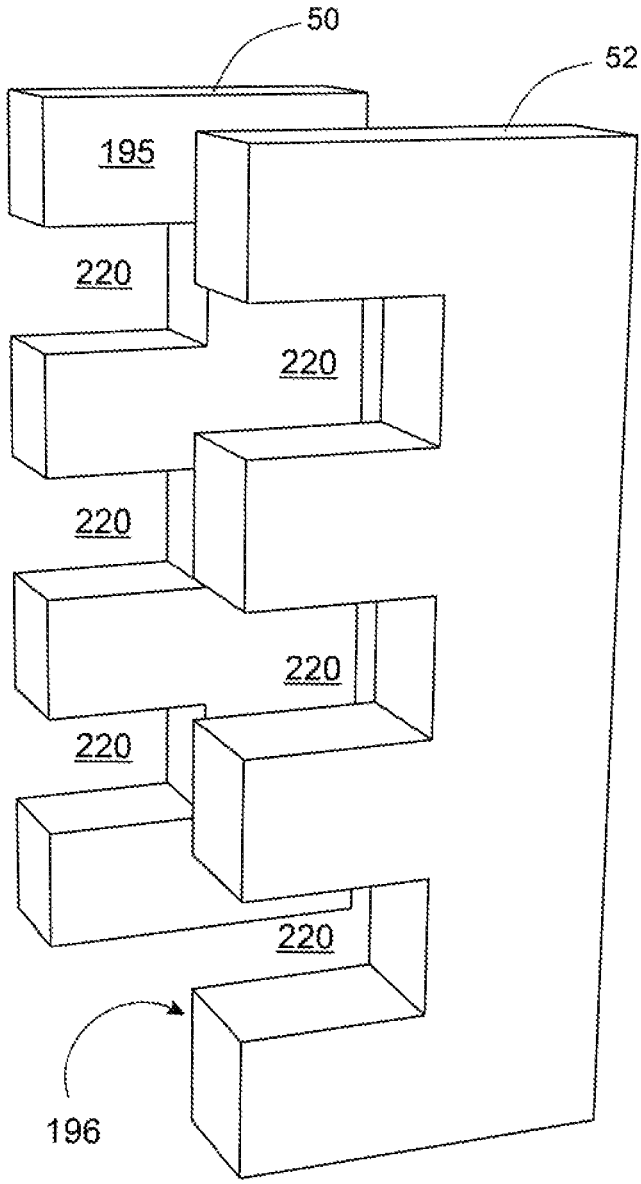
FIGS. 5A-5D are diagrammatic views of alternate embodiments of opposed electrodes for capacitive fluid level detection.
Figure 5B:
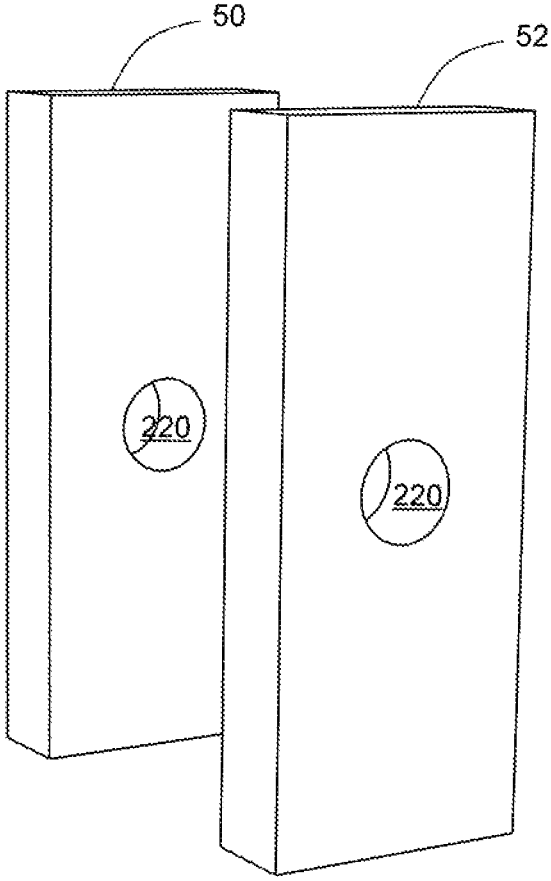
Figure 5C:
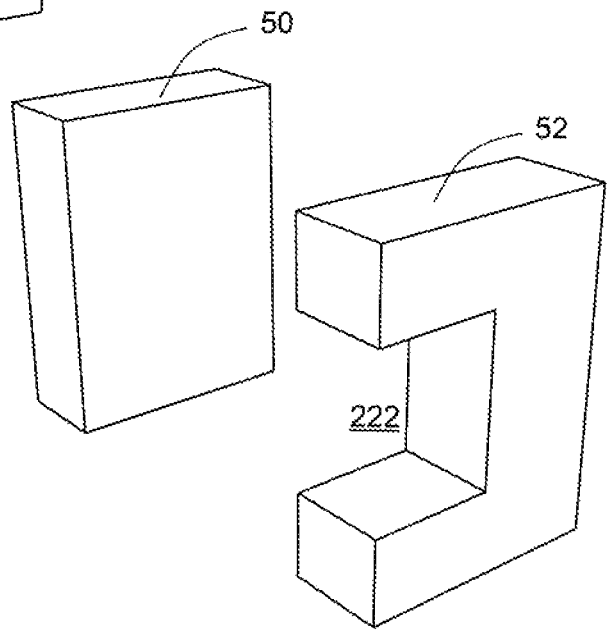

In still other embodiments, electrode interior surfaces 195, 196 face one another, FIG. 5A. At least one electrode 50, 52, has an open region 220, such as a hole or a cutout of material. During use, the electrode surfaces prevent the occupation of fluid while the open region allows fluid to spill into other locations of the housing. Sharp changes of capacitance readings are noticed at these locations of transition from and to the open region. The open region can be of any size and shape. FIG. 5B illustrates centered holes as open regions 220 in the electrodes. FIG. 5C notes a cutout or notch of material as the open region 222, but only in a single electrode 50. The cutout extends from an edge of the electrode to a central position.

Figure 5D:
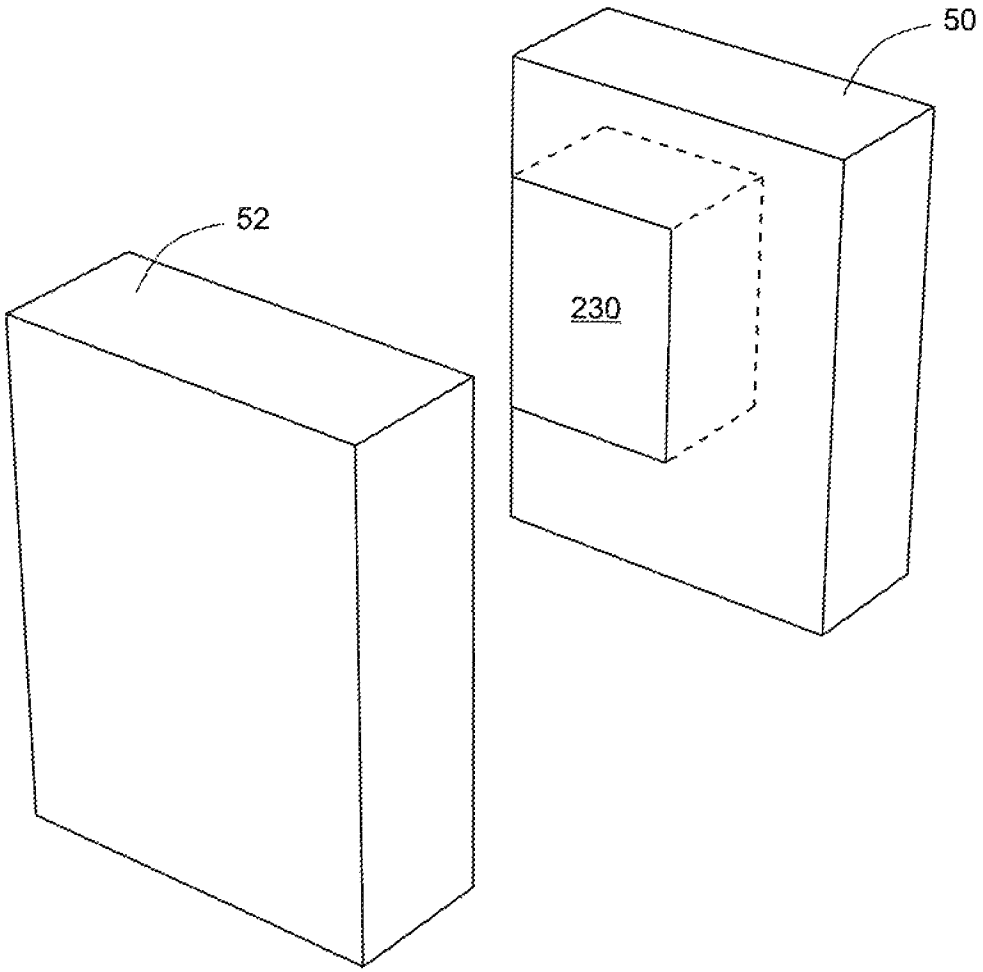
Figure 5E:
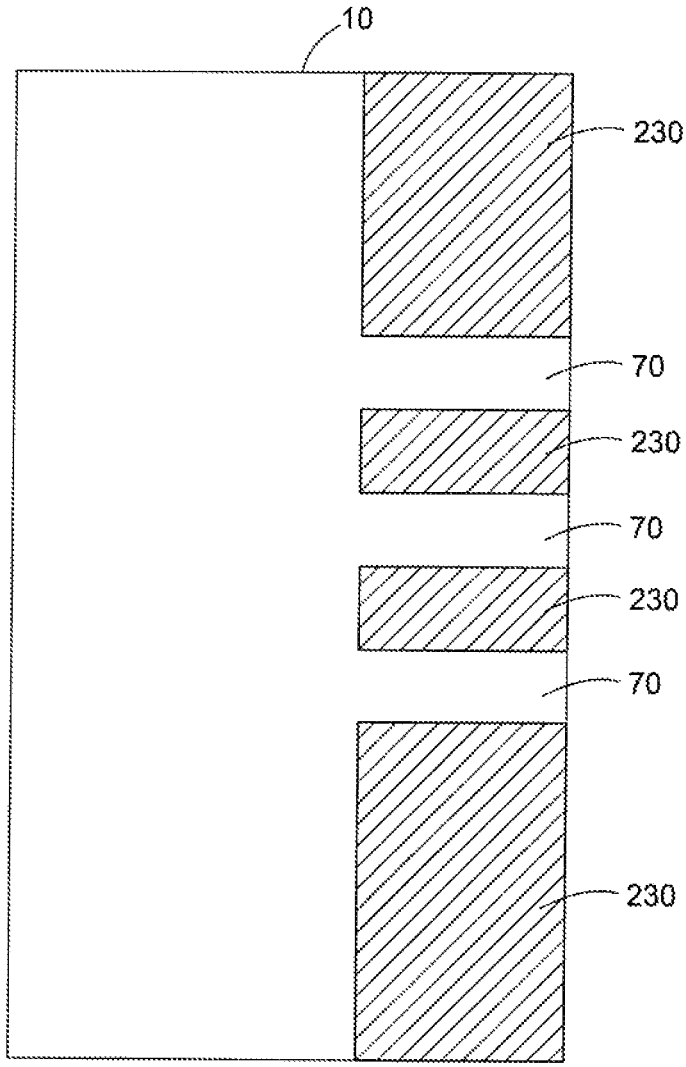
FIG. 5E is a diagrammatic view of still another alternate consumable supply item.
Figure 6:
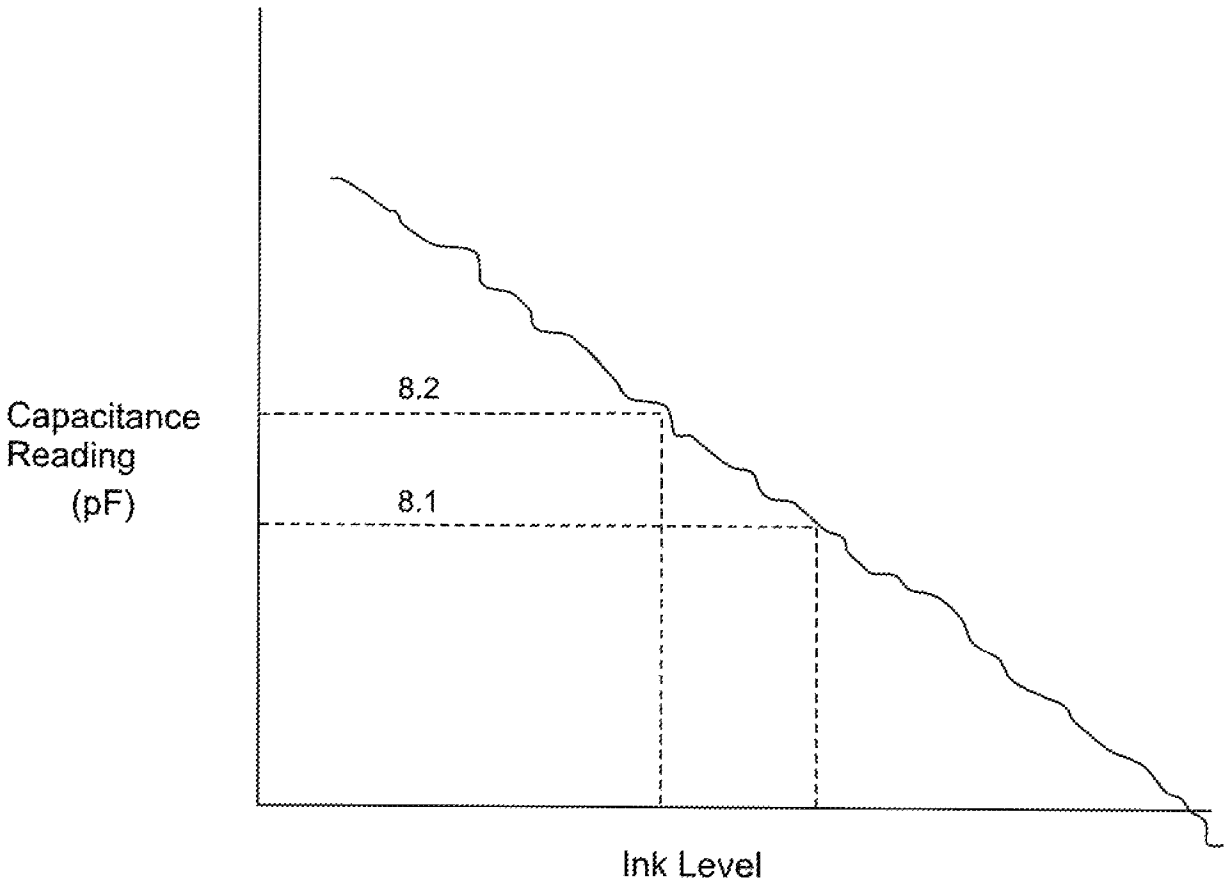
FIG. 6 is a graph of capacitance readings vs. ink level according to the prior art.

In FIG. 5D, sharp changes can be noticed in capacitance readings of fluid between electrodes 50, 52, but instead of an open region in an electrode, a change in material is effectuated. In this regard, a filled region 230 is emplaced in an electrode(s) having a substantially different dielectric constant in comparison to the dielectric constant of the material of the electrodes. The filled region can be of any shape and placement location in the electrode. The material can be plastic or air in a pocket, for example, when the electrodes are made of steel. In FIG. 5E, the notion of filled regions can be extended further into designs of housings, not just electrodes. In this instance, multiple filled regions 230 have materials with dielectric constants different than the material of the housing 10, such as that of FIGS. 1 and 2. It amplifies differences in capacitance readings as fluid transitions into expansive sections 70 and adds structural support to the expansive sections 70 as well as creating a housing having an overall a smooth exterior.

Relatively apparent advantages of the many embodiments include, but are not limited to, more accurately measuring the level of fluid in a supply item than is otherwise available with traditional raw capacitive measurement techniques. Advantages also introduce notions of uniquely shaped housings and electrodes.

The foregoing illustrates various aspects of the invention. It is not intended to be exhaustive. Rather, it is chosen to provide the best illustration of the principles of the invention and its practical application to enable one of ordinary skill in the art to utilize the invention, including its various modifications that naturally follow. All modifications and variations are contemplated within the scope of the invention as determined by the appended claims. Relatively apparent modifications include combining one or more features of various embodiments with features of other embodiments.

The invention claimed is:

1. A consumable supply item for an imaging device to hold an initial or refillable volume of liquid, comprising:

a rigid housing defining an interior to retain the volume of liquid; and a pair of opposed electrodes forming a capacitor having a capacitance that varies in response to an amount of liquid existing between the opposed electrodes, wherein a volume space between the opposed electrodes that can be filled with the amount of liquid varies along a length of the electrodes, wherein the volume space includes a support material connecting to each of the opposed electrodes to provide a mechanical support to the each electrode and create a region between the opposed electrodes that cannot be filled by the amount of liquid.

2. The supply item of claim 1, wherein the support material is disposed centrally along the length of the electrodes about midway from a top to a bottom of the electrodes.

3. The supply item of claim 1, wherein the support material is polypropylene or polyethylene.

4. The supply item of claim 1, wherein the support material defines an opening therein so the amount of liquid can pass through a thickness of the support material.

5. The supply item of claim 1, wherein each of the opposed electrodes is tin plated steel.

6. The supply item of claim 5, wherein an exterior of the each of the opposed electrodes is covered within the interior of the rigid housing with a coating up to about 1.5 mm in thickness.

7. The supply item of claim 6, wherein the coating is polypropylene or polyethylene.

8. A consumable supply item for an imaging device to hold an initial or refillable volume of liquid, comprising:

a rigid housing defining an interior to retain the volume of liquid; and a pair of opposed electrodes disposed in the interior of the rigid housing forming a capacitor having a capacitance that varies in response to an amount of liquid existing between the opposed electrodes, wherein each of the opposed electrodes has an interior surface area facing the interior surface of the other of the opposed electrodes, the interior surface area of at least one of the opposed electrodes having an open region, further including a common support material connected to said each of the opposed electrodes along a respective said interior surface area to provide a mechanical support to the each electrode and create a region between the opposed electrodes that cannot be filled by the amount of liquid.

9. The supply item of claim 8, wherein the open region is a hole through one the at least one of the opposed electrodes.

10. The supply item of claim 8, wherein the open region is a cutout of material from an edge of the at least one of the opposed electrodes.

11. The supply item of claim 8, wherein the open region is filled with a material having a first dielectric constant substantially different than a second dielectric constant of a material defining the interior surface area of the at least one of the opposed electrodes.

12. The supply item of claim 8, wherein the opposed electrodes are tin plated steel.

13. A consumable supply item for an imaging device to hold an initial or refillable volume of liquid, comprising:

a rigid housing defining an interior to retain the volume of liquid; and a pair of opposed electrodes disposed within the interior to form a capacitor having capacitance values that vary in response to an amount of liquid existing between the opposed electrodes, wherein a volume space between the opposed electrodes that can be filled with the amount of liquid varies from a top to a bottom of the electrodes, the imaging device using the capacitance values that change abruptly at each change in the volume space to recalibrate the existing fluid levels in the rigid housing, wherein the volume space includes a support material connecting to each of the two plates to provide a mechanical support to the two plates and create a region between the two plates that cannot be filled by the amount of liquid.

14. The supply item of claim 13, wherein the opposed electrodes are two plates of tin plated steel.

15. The supply item of claim 14, wherein the two plates are substantially parallel to each other.

16. The supply item of claim 15, wherein an exterior of the two plates are covered within the interior of the rigid housing with a coating up to about 1.5 mm in thickness.

17. The supply item of claim 16, wherein the coating is polypropylene or polyethylene.

* * * * *